United States Patent [19]

Baughman et al.

[11] Patent Number: 4,489,856

[45] Date of Patent: Dec. 25, 1984

[54] METHOD AND APPARATUS FOR MOVING A NOZZLE BETWEEN A STORAGE POSITION AND A POSITION FOR APPLYING A FLUID

[75] Inventors: Richard C. Baughman, Geneseo; David S. Bump, Rochester, both of N.Y.

[73] Assignee: Eastman Kodak Company, Rochester, N.Y.

[21] Appl. No.: 380,965

[22] Filed: May 24, 1982

[51] Int. Cl.[3] ..... B67D 5/46

[52] U.S. Cl. ..... 222/148; 222/154

[58] Field of Search ..... 222/160, 154, 356, 357, 222/358, 148; 73/864.22, 864.11, 864.12; 118/302; 239/104; 141/284

[56] References Cited

U.S. PATENT DOCUMENTS 2,245,657 6/1941 Eppler, Jr. .
3,740,041 6/1973 Jones .
3,908,869 9/1975 Little .
4,158,035 6/1979 Haase et al. ..... 73/864.11 X

OTHER PUBLICATIONS

Article entitled Adhesive Applicators for High Speed Machines—pp. 56–59.

*Primary Examiner*—Stanley H. Tollberg
*Attorney, Agent, or Firm*—G. Herman Childress

[57] ABSTRACT

A nozzle for applying an air-curable adhesive to sheets of paper normally is located in a storage position with the end of the nozzle inserted into a liquid in a sump. This prevents adhesive material in the end of the nozzle from drying out or caking and thereby clogging the end of the nozzle. When the nozzle is to be used for applying adhesive, the nozzle is lifted out of the sump, the sump is moved, and the nozzle is then moved into an operating position for applying the adhesive. Also disclosed is apparatus for automatically returning the nozzle to its storage position with the end of the nozzle in the sump at the end of a cycle of operation, or when normal operation stops because of a power failure, for example.

6 Claims, 5 Drawing Figures

METHOD AND APPARATUS FOR MOVING A NOZZLE BETWEEN A STORAGE POSITION AND A POSITION FOR APPLYING A FLUID

BACKGROUND OF THE INVENTION

1. Field of the Invention

The invention relates to method and apparatus for moving a nozzle between a storage position and a position for applying an adhesive or other fluid material. More specifically, the invention relates to such a method and apparatus wherein the nozzle is normally in a storage position with its end in a container of solvent for the adhesive to be dispensed. The container is moved out of the way and the nozzle advanced to its operating position where it applys adhesive to sheets of paper or the like.

2. Background of the Invention

U.S. Pat. No. 3,908,869 issued on Sept. 30, 1975 in the name of W. A. Little and is entitled Method and Apparatus for Dispensing Air-Curable Viscus Materials. This patent discloses apparatus and method for dispensing an air-curable material, such as a silicone rubber, without allowing the material to partially cure and clog portions of the dispensing system. Clogging of the system is avoided by immersing the dispensing end of the nozzle in a reservoir of liquid, such as oil, when the nozzle is not being used. The oil forms an air tight seal around the end of the nozzle. After the nozzle is immersed in the oil, all air-contacted material in the nozzle is purged from the nozzle into the oil and then a back pressure is applied to the material in the nozzle to draw part of it upwardly into the nozzle and thus draw some of the oil from the reservoir into the nozzle. The apparatus of the Little patent is described as useful for forming a silicone rubber gasket by removing the nozzle from the reservoir and passing it along a predetermined path above a work surface while dispensing rubber through the nozzle to thereby form the gasket.

It also is known to clean a nozzle that is moved through a series of liquids, such as liquids in test tubes, in order to prevent contamination of samples in the various test tubes. See, for example, U.S. Pat. No. 3,740,041 which issued on June 19, 1973 in the name of A. R. Jones for Reagent Mixing Apparatus.

U.S. Pat. No. 2,245,657, issued on June 17, 1941 to A. Eppler for Apparatus for Applying Adhesive to Shoe Parts, discloses a glue pot from which adhesive is pumped through openings leading into the central portion of a brush. When the use of the apparatus is to be discontinued for any substantial period of time, the glue can be prevented from hardening in the brush by raising about the brush a cup or container having therein water or other liquids.

SUMMARY OF THE INVENTION

In accordance with the present invention a nozzle is mounted for movement between a storage position and a position for applying a fluid, such as adhesive. A sump is provided. Means responsive to movement of the nozzle between its first and second positions locates the sump in a first position for receiving an end of the nozzle when the nozzle is moved into its storage position and for locating the sump in a second position spaced from the end of the nozzle when the nozzle is moved from its storage position into its position for applying fluid. Preferably, means are coupled to the nozzle mounting means and to the locating means for automatically repositioning the sump in its first position and the nozzle in its storage position during periods when the nozzle is not applying fluid.

A method in accordance with the present invention comprises the steps of moving a nozzle between a storage position and a position for applying fluid, such as adhesive. The method further comprises moving a sump in response to movement of the nozzle between its first and second positions. The sump is located in its first position for receiving an end of the nozzle when the nozzle is moved to its storage position, and the sump is located in a second position spaced from the end of the nozzle when the nozzle is moved from its storage position into its position for applying adhesive. Preferably the sump is automatically returned to its position for receiving the nozzle during periods of nonuse.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 4 is a view similar to FIGS. 1–3 showing the nozzle in its operating position for applying fluid to a sheet of paper or the like.

DESCRIPTION OF THE PREFERRED EMBODIMENT

Figure 1:
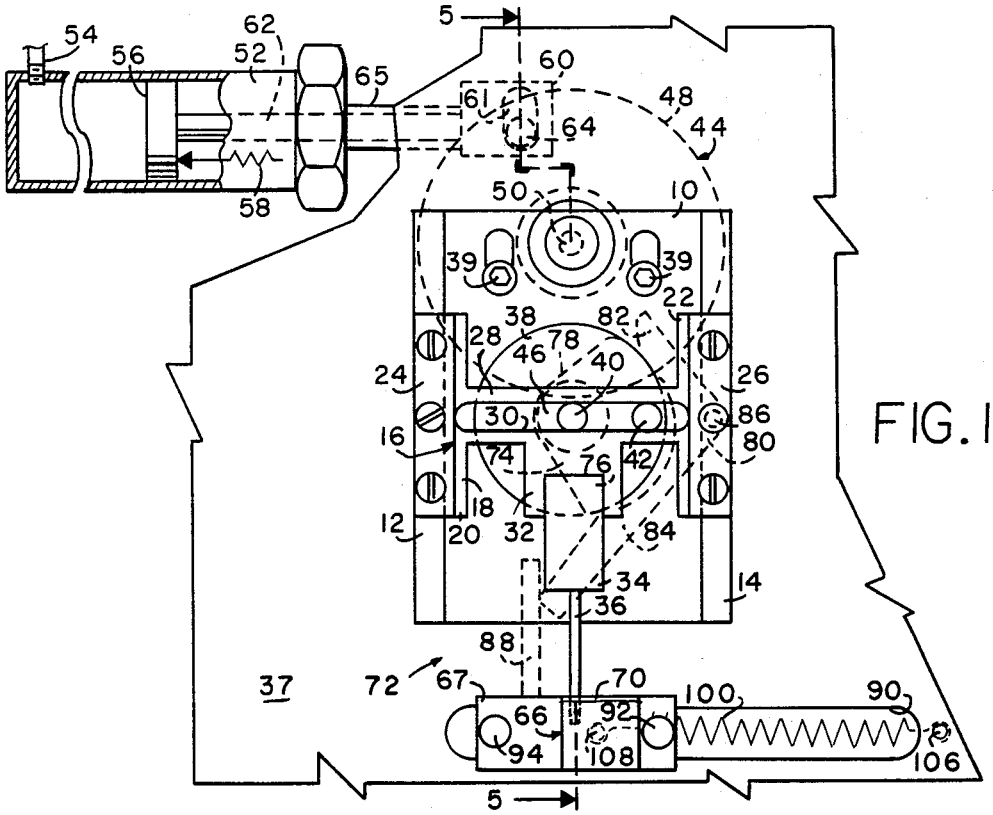
FIG. 1 is a view of a mechanism of the invention for moving a nozzle between a storage position and a position for applying a fluid, the mechanism being illustrated with the nozzle in the storage position.

Referring now to FIG. 1 of the drawings, the apparatus of the present invention includes a mechanism plate 10 that is disposed in a generally vertical position. Connected to opposite side edges of plate 10 are end walls 12 and 14 that are perpendicular to plate 10.

Mounted on plate 10 and between walls 12 and 14 is a scotch yoke mechanism generally designated 16. Mechanism 16 comprises a yoke member 18 having end portions 20 and 22 that are closely adjacent the end walls 12 and 14, respectively. A pair of guide walls 24, 26 are secured to the walls 12 and 14, respectively, in spaced relation to plate 10. Plate 10, end walls 14, 16 and guide walls 24,26 provide guideways for guiding movement of the end portions 22 and 24 of the yoke member in a vertical direction.

Yoke member 18 has a central portion 28 that extends between the end portions 20 and 22 and is spaced from plate 10. There is an elongate generally horizontal slot 30 in the central portion 28 of the yoke member, the slot extending almost the entire width of the central portion. Projecting downwardly from the central portion 28 is a nozzle mounting portion 32 of the yoke member.

Secured to the nozzle mounting portion 32 of the yoke member is a nozzle 34 that has a tip end 36 through which a liquid material can be dispensed. The liquid to be dispensed can be furnished to the nozzle from a source of pressurized material (not shown). Also, nozzle 34 can have a solenoid-operated valve forming part of the nozzle, or a valve can be mechanically opened and closed.

The apparatus described hereinbefore can be assembled on plate 10, and the plate can be secured to another plate or support 37 by bolts 39. Alternatively, the apparatus can be assembled on a single plate 10 or 37.

The scotch yoke mechanism 16 further comprises a yoke drive wheel 38 that is located between the central portion 28 of yoke member 18 and the mechanism plate 10. Drive wheel 38 is secured to one end of a shaft 40 for rotation with the shaft. The shaft projects through the plates 10 and 37 and is rotatable relative to such plates. A pin 42 is secured to the wheel 38 and projects from the surface of the wheel opposite from the mechanism plate 10. Pin 42 is eccentrically mounted on the plate relative to the shaft 40 and projects through the slot 30 in the yoke member 18. With this arrangement, rotation of wheel 38 about the axis of shaft 40 effects movement of pin 42 in an annular path to produce movement of the yoke member 18 along a straight line vertical path. As explained in more detail later, this vertical movement moves the nozzle 34 from a storage position to an operating position.

Shaft 40 is rotated by a drive mechanism generally designated 44. The drive mechanism comprises a gear 46 that is secured to the shaft 40 and located on the side of plates 10 and 37 opposite from the yoke member 18. Gear 46 meshes with a gear 48 that rotates about a shaft 50. Gear 48 is driven by a pressure cylinder 52. Cylinder 52 preferably is operated by pneumatic pressure provided through a line 54 but can also be hydraulically operated, if desired. Cylinder 52 has a piston 56 that is urged to the right (as viewed in FIGS. 1–4) in response to the introduction of fluid under pressure through line 54. The piston 56 is urged to the left by a spring 58. Thus when fluid pressure is withdrawn from line 54 the piston 56 can move to the left. The cylinder 52 is secured to a suitable support, not shown.

A coupling 60 having a vertical slot 61 is secured to one end of a rod 62. The other end of rod 62 is secured to the piston 56 and projects from the right end of the cylinder. The coupling 60 on the rod is connected to the gear 48 by a pin 64 on the gear projecting into slot 61. The connection between the rod and the gear is offset from the axis of the shaft 50 so that the gear can be rotated in response to introduction of fluid under pressure through line 54 into the left end of the cylinder 52 or movement of the piston by the spring 58 upon withdrawal of such pressure. Thus when fluid is introduced through line 54 the piston 56 is moved to the right against the pressure exerted by spring 58. This causes extension of rod 62 and clockwise rotation of gear 48. There is a corresponding counterclockwise rotation of gear 46, shaft 40 and wheel 38. Such movement of the drive wheel 38 in a counterclockwise direction swings the pin 42 through an arcuate path and effects vertical movement of the yoke member 18 first upwardly and then downwardly. When fluid pressure is withdrawn, spring 58 moves the piston to the left effecting the reverse movement of the gears 46 and 48, thereby rotating shaft 40 and wheel 38 in a clockwise direction to return the yoke member to its original position. Movement of the piston to the left (as viewed in FIGS. 1–4 is stopped by a sleeve 65 on rod 62 contacting coupling 60 and the right end of cylinder 52.

Figure 4:
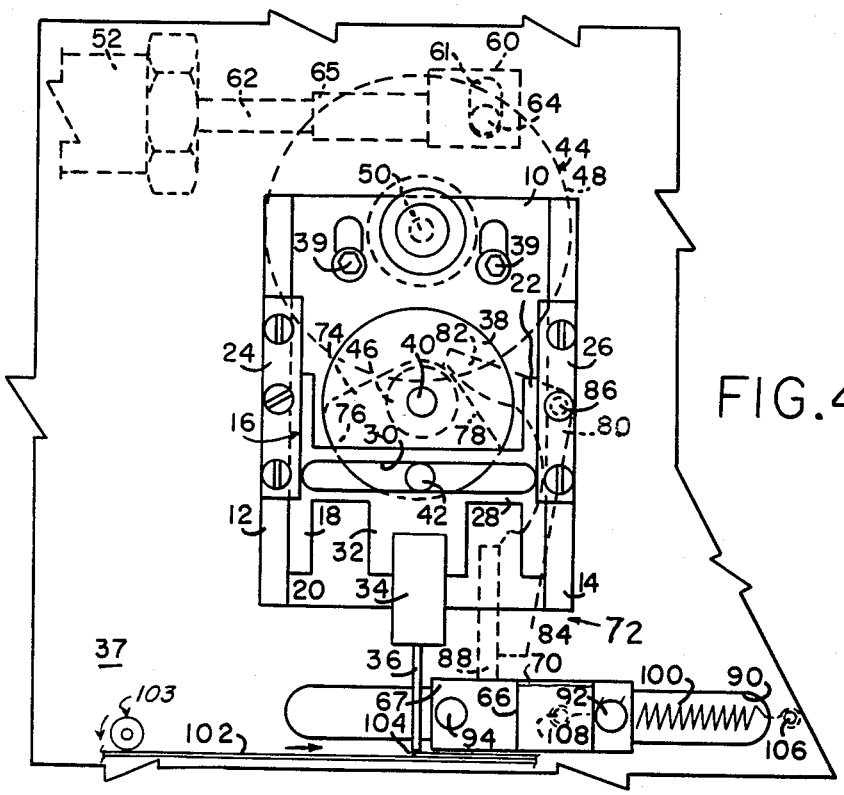

A sump generally designated 66 is carried by a slide 67 for movement between the positions illustrated in FIGS. 1 and 4. When the sump is in its FIG. 1 position where it receives the tip end 36 of nozzle 34 when the nozzle is moved into its storage position. When the sump is in its FIG. 4 position it is located beside the path of movement of the nozzle so that the nozzle can be moved to its operating position.

The sump comprises a hollow container 68 having thereon a seal 70 of rubber or similar elastomeric material. Preferably the container 68 is formed of a clear transparent material and receives a liquid solvent, such as water, for the material being dispensed through the nozzle. Thus when the nozzle tip end 36 is in the sump any material in the lower end of the nozzle will not dry out or clog the end of the nozzle. By making container 68 of a transparent material the machine operator can readily determine if there is sufficient liquid in the container to cover the tip end of the nozzle. The seal 70 prevents spilling and drying of the liquid in the container.

A mechanism generally designated 72 is provided for moving the sump 66 between the positions shown in FIGS. 1 and 4 simultaneously with movement of the nozzle between its storage position (FIG. 1) and its operating position (FIG. 4). Mechanism 72 comprises a cam 74 secured to the shaft 40 for rotation therewith. As noted in FIG. 5, cam 74 is located between plates 10 and 37 and the gears 46, 48. The cam profile includes a first portion 76 which is generally circular in cross section and constitutes the high portion of the cam profile and a second portion 78 which constitutes the low portion of the cam profile and is nearer to the axis of shaft 40.

A cam follower 80 has two substantially perpendicular arm portions 82 and 84. The cam follower is mounted for pivotal movement by a pin 86 that extends through the follower at the intersection of the two arms. Pin 86 is supported by the plate 37. Arm 82 of the follower bears against the profile of the cam 74 so that rotation of the cam about the axis of shaft 40 can effect pivotal movement of the cam follower about the axis of pin 86.

The lower end of follower arm 84 is engaged by a stud 88 carried by the slide 67 on which the sump is mounted. Slide 67 projects through a guide slot 90 in the plate 37, and stud 88 and sump 66 are on opposite sides of the plate. The portion of slide 67 on the right side of plate 37 is larger in a vertical direction than slot 90. The portion of the slide on the right side of plate 37 also extends in a vertical direction by the portion of the slide in slot 90. A pair of pins 92,94 project from the extended portions of the slide through slot 90. Retainers 96 on the ends of the pins and the enlarged portion of slide 67 mount the slide for movement along plate 37. Sleeves 98 on pins 92,94 facilitate movement of the slide along the plate.

Slide 67 is urged to the right, as viewed in FIGS. 1–4, by a spring 100 which is connected at its ends to pins 106,108 on plate 37 and slide 67.

Figure 2:
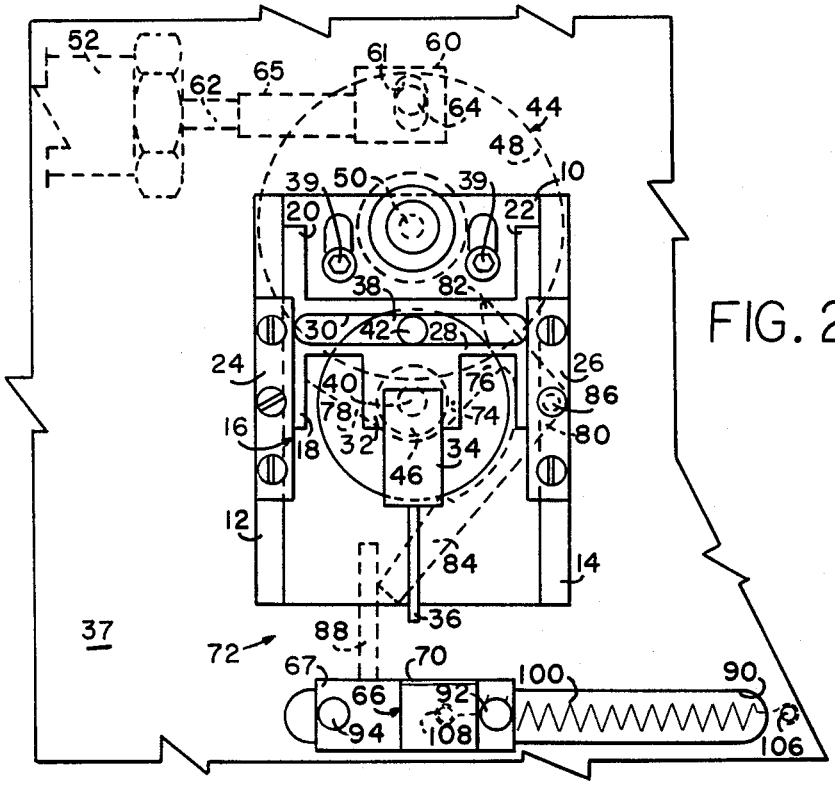
FIG. 2 is a view similar to FIG. 1 showing the parts in an intermediate position after initial movement of the nozzle away from the storage position and before the nozzle reaches its operating position.
Figure 3:
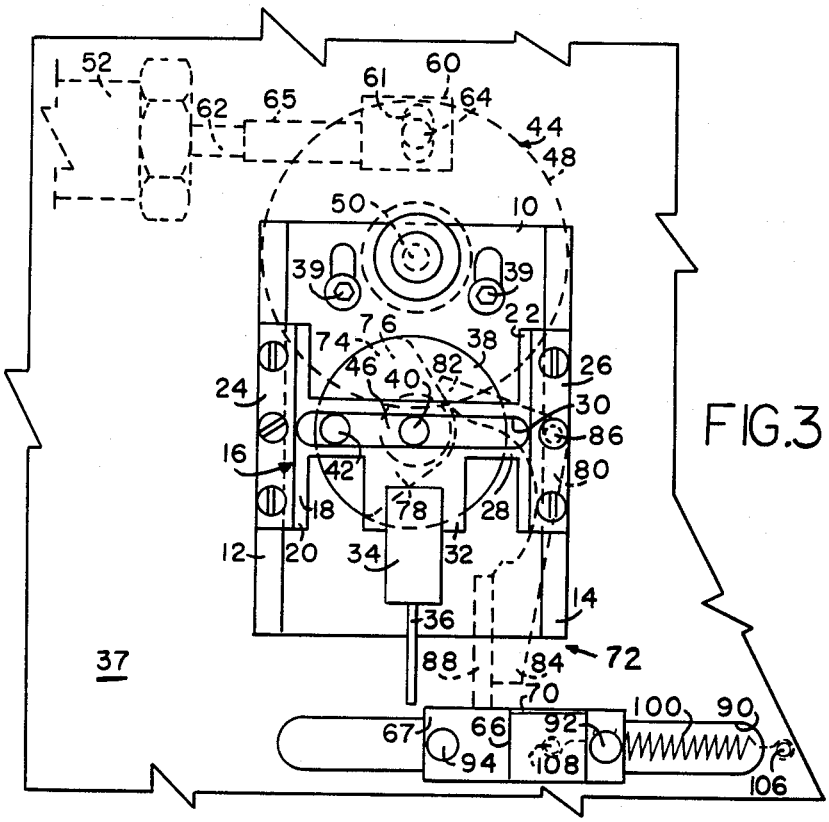
FIG. 3 is a view similar to FIGS. 1 and 2 but showing the nozzle in a further intermediate position between its storage position and its operating position.

The force exerted by spring 100 on slide 67 urges the stud 88 against the lower end of the arm 84 of the cam follower, thereby urging the cam follower in a counterclockwise direction about the axis of pin 86. This spring force maintains the outer end portion of arm 82 in contact with the cam 74. When arm 82 of the cam follower contacts the high portion 76 of the cam profile as shown in FIGS. 1 and 2, the cam follower 80, and the slide 67 and sump 66 are held in the positions illustrated in FIG. 1. When the cam is rotated sufficiently to allow the cam follower to travel along the low portion 78 of the cam profile, spring 100 is effective to move the slide 67 and thus the sump 66 to the right to the position shown in FIGS. 3 and 4 wherein the sump is spaced from the vertical path of the nozzle 34.

Figure 5:
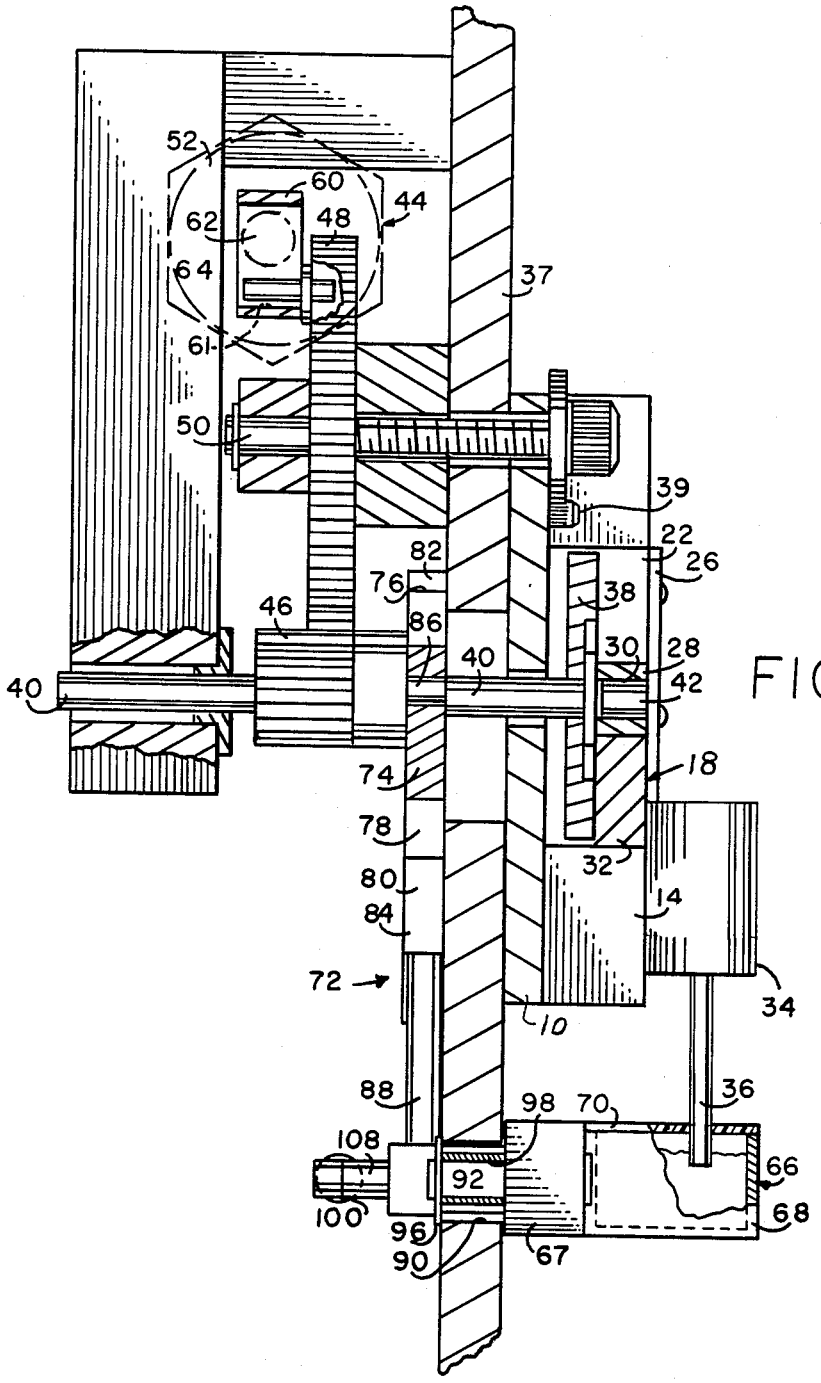
FIG. 5 is an enlarged cross-section taken along line 5—5 of FIG. 1.

Operation of the apparatus for applying adhesive to sheets will now be described. Initially the parts are in the storage position illustrated in FIGS. 1 and 5. In this position the tip end 36 of nozzle 34 is located within the sump 66 and the liquid in the sump covers the tip end of the nozzle as shown in FIG. 5 to prevent drying out or caking of the adhesive material dispensed by the nozzle.

When it is desired to move the nozzle to its dispensing position, air or other fluid under pressure is introduced through line 54 into the cylinder 52 to drive the piston 56 therein toward the right. This extends piston rod 62 to effect clockwise rotation of gear 44 and counterclockwise rotation of gear 46, thereby rotating shaft 40 in a counterclockwise direction. Such rotation of the shaft causes rotation of the yoke drive wheel 38 to move the pin 42 on the wheel along an annular path eccentric with the axis of shaft 40.

When the pin 42 is rotated 90 degrees from the FIG. 1 position, the parts are in the position illustrated in FIG. 2. At that time the nozzle 34 has been lifted to a position where the tip end 36 is retracted from sump 66. However, cam follower arm 82 is still riding on the high portion 76 of the cam profile, thereby holding the sump in its position immediately beneath the nozzle. During the next 90 degrees of rotation of the pin 42 to its FIG. 3 position, the cam follower arm 82 travels along the low portion 78 of the cam profile. This allows the stud 88, the slide 67 and thus the sump 66 to move to the right under a force exerted by the spring 100. Thus the sump 66 is moved out of line with the vertical path of movement of the nozzle 34, and the nozzle 34 can then move downwardly so that the parts can occupy the position illustrated in FIG. 3 wherein the sump is to the right of the vertical path of the nozzle and the nozzle is essentially at the same position illustrated in FIG. 1.

An additional 90 degree counterclockwise rotation of the pin 42 brings the parts to the position illustrated in FIG. 4 wherein the nozzle is located in a dispensing or operating position. At this time the cam follower continues to be located along the low portion 78 of the cam profile so that the sump is held to the right and out of the way of the nozzle. The nozzle has moved downwardly from the position illustrated in FIG. 3 and is immediately above the path of a piece of paper 102, FIG. 4. As the paper is driven past the tip end 36 of the nozzle, the nozzle can dispense a line of adhesive 104 onto the upper surface of the paper. The paper is being driven from left to right as illustrated by the arrow in FIG. 4.

When a job has been completed, the nozzle preferably is returned from its FIG. 4 position to its FIG. 1 position to avoid drying of adhesive in the end of the nozzle. This is accomplished by shutting off the fluid supply to line 54 and allowing the pressure within the left end of cylinder 52 either to return to atmospheric pressure or to be reduced to a level where the spring 58 is effective to move the piston 56 toward the left, thereby to retract the piston rod 52 and effect counterclockwise rotation of gear 44. As this occurs the gear 46 is rotated in a clockwise direction to rotate the shaft 40, wheel 38, and cam 74 in a clockwise direction. The parts then move from the FIG. 4 position through the FIG. 3 position and the FIG. 2 position back to the FIG. 1 position. As this occurs the nozzle 34 moves upwardly in a straight line through its FIG. 3 position to its FIG. 2 position. After the nozzle has passed through its FIG. 3 position the cam follower moves from the low portion of the cam profile to the high portion of the cam profile thereby causing clockwise movement of the cam follower about pin 86. During such movement of the cam follower the arm 84 thereof engages stud 88 and moves it to the left to return it to the position illustrated in FIGS. 1 and 2. Then, during the final portion of the movement of the piston 56 to the left the nozzle is lowered in a straight line from its FIG. 2 position to its FIG. 1 position and the tip end 36 thereof again enters the sump.

The scotch yoke mechanism 16 moves the nozzle 34 in a straight line path in a first direction away from its storage position and then in a second direction opposite from the first direction through the storage position to its operating position. In response to such movement the sump is moved in a direction perpendicular thereto between its first position wherein it is located for receiving the tip end of the nozzle and its second position wherein it is out of the path of movement of the nozzle to allow movement of the nozzle to its operating position.

As mentioned previously, spring 58 in cylinder 52 serves to return the mechanism to the storage position as shown in FIG. 1. Provision could be made for fluid under pressure to be introduced into the right side of the piston 56 in the cylinder in order to return the apparatus to the storage position. However, the use of a spring is preferred because the spring is operable to return the apparatus to the storage position in the event of a power failure or some other event which shuts off the fluid supply to line 54. Thus the tip end of the nozzle 34 is always returned to the sump by the spring 58 in order to prevent adhesive in the end of the nozzle from drying out during non-gluing operations or periods of power failure.

The invention has been described in detail with particular reference to a preferred embodiment thereof, but it will be understood that variations and modifications can be effected within the spirit and scope of the invention as described hereinabove and is defined in the appended claims.

We claim:

1. Apparatus for applying a fluid, the apparatus comprising:

a nozzle;

means mounting said nozzle for movement between (1) a storage position and (2) an operating position for applying fluid;

a sump;

means coupled to the sump and the nozzle for locating the sump (1) in a first position for receiving an end of the nozzle when the nozzle is in its storage position and (2) for locating the sump in a second position spaced from the nozzle when the nozzle is in its operating position, and means coupled to said nozzle mounting means and to said locating means for automatically returning the sump to its first position and the nozzle to its storage position during periods when the nozzle is not applying fluid.

2. In apparatus for applying a fluid, such as an adhesive, through an end of a nozzle onto a workpiece, the improvement comprising:

means mounting the nozzle for straight-line movement in first and second opposite directions along a path between a storage position and an operating position for applying fluid to a workpiece;

a sump adapted to contain a solvent for the fluid;

means mounting the sump for movement between (1) a first position for receiving the end of the nozzle when the nozzle is in its storage position and (2) a second position away from the path of movement of the nozzle; and means for effecting movement of the nozzle and the sump in a predetermined sequence of movements from the storage position of the nozzle and the first position of the sump, such movements comprising (1) first moving the nozzle in the first direction out of its storage position to remove the end of the nozzle from the sump, (2) then moving the sump from its first position to its second position, (3) then moving the nozzle in the second direction to its operating position for applying fluid, and (4) subsequently returning the sump to its first position and the nozzle mounting means to its storage position.

3. The invention as set forth in claim 2 wherein the means for effecting movement comprises a fluid cylinder operatively coupled to the nozzle mounting means and the sump mounting means, the cylinder having a piston therein movable in a first direction in response to introduction of fluid under pressure into the cylinder, and the cylinder having a spring therein engageable with the piston for moving the piston in a second direction opposite to the first direction, the piston being connected to the nozzle mounting means and the sump mounting means so that (1) movement of the piston in one of its directions is effective to move the nozzle from its storage position to its operating position and to move the sump mounting means from its first position to its second position and (2) movement of the piston in another of its directions is effective to return the nozzle from its operating position to its storage position and to move the sump mounting means from its second position to its first position.

4. The invention as set forth in claim 2 wherein the nozzle mounting means comprises a scotch yoke mechanism, and the means for effecting movement comprises a cam driven by the scotch yoke mechanism and a cam follower engageable with the cam and coupled to the sump mounting means for moving the sump mounting means in response to operation of the scotch yoke mechanism.

5. A method for applying adhesive through an end of a nozzle and preventing drying of adhesive in the end of the nozzle during periods when adhesive is not being applied, the method comprising the steps of:

storing the end of the nozzle in a sump containing a solvent for the adhesive;

removing the end of the nozzle from the sump when the nozzle is to apply adhesive and moving the nozzle to an operating position wherein adhesive is dispensed from the nozzle, and continuously urging the nozzle away from its operating position and toward the sump anytime the nozzle is in its operating position to cause the nozzle to return to the sump during periods when adhesive is not being applied.

6. The invention as set forth in claim 5 further comprising moving the sump into a position for receiving the end of the nozzle as the nozzle returns from its operating position toward the sump, and moving the sump out of such position as the nozzle moves from the sump toward its operating position.

* * * * *